US007819498B2

(12) United States Patent
McReynolds

(10) Patent No.: US 7,819,498 B2
(45) Date of Patent: Oct. 26, 2010

(54) METHODS AND SYSTEMS USING PRINTHEAD TANK MEMORY TO DETERMINE PRINTHEAD TANK CONFIGURATION

(75) Inventor: Jason Todd McReynolds, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 494 days.

(21) Appl. No.: 11/959,593

(22) Filed: Dec. 19, 2007

(65) Prior Publication Data

US 2009/0160886 A1 Jun. 25, 2009

(51) Int. Cl.
*B41J 29/393* (2006.01)
*B41J 2/175* (2006.01)

(52) U.S. Cl. ..... 347/19; 347/86

(58) Field of Classification Search ..... 347/19, 347/86

See application file for complete search history.

(56) References Cited

U.S. PATENT DOCUMENTS

| | | | | |
|---|---|---|---|---|
| 6,155,664 | A | 12/2000 | Cook | |
| 6,158,850 | A | 12/2000 | Cook | |
| 6,302,527 | B1 | 10/2001 | Walker | |
| 6,672,695 | B1 | 1/2004 | Naka et al. | |
| 6,935,716 | B2 * | 8/2005 | Hatasa et al. | 347/19 |
| 6,938,976 | B2 * | 9/2005 | Siwinski et al. | 347/19 |
| 7,137,684 | B2 * | 11/2006 | Kim et al. | 347/19 |
| 7,212,637 | B2 | 5/2007 | Salisbury | |

* cited by examiner

*Primary Examiner*—Julian D Huffman

(57) ABSTRACT

Methods and systems using printhead tank memory to determine printhead tank configuration are provided in accordance with embodiments of the invention. One example embodiment of the invention may include a printhead ink tank. The printhead ink tank may include a memory tag readable by a printer memory tag reader in communication with a printer controller. The memory tag may further include ink tank configuration instructions that include at least one of an ink tank configuration identifier or at least one ink tank location identifier. The ink tank configuration instructions can cause the printer controller to perform at least one memory operation associated with the memory tag.

15 Claims, 6 Drawing Sheets

METHODS AND SYSTEMS USING PRINTHEAD TANK MEMORY TO DETERMINE PRINTHEAD TANK CONFIGURATION

FIELD OF THE INVENTION

The invention relates generally to computer printers, and more specifically, to methods and systems using printhead tank memory to determine printhead tank configuration.

BACKGROUND OF THE INVENTION

Printing and imaging devices, for example computer printers, are known, and include dot-matrix printers, piezo-electric ink jet printers, laser printers, thermal ink jet printers, hand-held ink jet printers, and other ink jet printing devices. Certain computer printers are configured to use tank-style printheads having a combination of monochromatic and multi-colored ink tanks. For example, a printhead may include one monochromatic ink tank and one multi-colored ink tank that includes yellow, cyan, and magenta ink wells in a single ink tank (CMY). In another example, printheads may be configured to have individual ink tanks for each ink color—such as a monochromatic ink tank, a yellow ink tank, a cyan ink tank, and a magenta ink tank. Other example printheads are configured to include a single ink tank having monochromatic, yellow, cyan, and magenta (CMYK) wells in the single tank. The various ink tank configurations provide options for consumers whose ink and printing usage varies.

Ink tanks may be configured to include a memory tag or memory device to store information for the operation of the printhead, the individual ink tank, and the printer. In some configurations, when a memory reader is to be aligned with or be in close proximity to the memory of, for example a configuration including an radio frequency identification (RFID) memory tag or a standard read or read/write memory providing temporary electrical connection with a memory reader, the printhead carriage moves to align an ink tank memory tag with a tank memory tag reader. Upon alignment, the tank memory tag reader performs the memory operation, for example a read or a write to the memory tag. The printhead carriage indexes along its path so as to align the next ink tank memory tag, for example on the next ink tank, with the memory tag reader and performs the next memory operation. This printhead carriage indexing is typically performed for each ink tank, and in printhead configurations having multiple, interchangeable ink tanks, for each possible ink tank that could be installed.

Each read and/or write cycle may take as much as about 500 milliseconds to complete. Accordingly, if an indexing and read and/or write step is performed for each ink tank, and the printhead has four tanks (e.g., CMYK), then it may take as much as about 2 seconds or more to complete a complete memory operation. Currently, even when the printhead contains fewer than the default four ink tanks (e.g., one monochromatic ink tank and one tri-color ink tank (CMY)), the printhead carriage indexes four times exactly as if there were four ink tanks. Similarly, ink tank configurations having memory tags that are in constant electrical connection and do not require physical alignment with a memory tag reader may still be subject to excess read and/or write operations when the printer controller executes read and/or write steps for each possible ink tank, even if there are fewer than the default ink tanks installed.

For example, a printer installed with a printhead having two ink tanks—one monochromatic and one tri-colored (CMY)—would initially align the printhead carriage so that the monochromatic ink tank memory tag is aligned with the memory tag reader to perform the read and/or write step. Next, the printhead carriage will index to the location where a yellow ink tank would be placed, and the memory tag for the second tri-color tank would be located so as to be in the same position, allowing the next read and/or write step for the tri-color ink tank to be performed. However, because the printer is unaware that there are no other ink tanks, the printhead carriage will be advanced to the location of the cyan ink tank and then to the location of the magenta ink tank. The printers are configured in this manner so as to have a standard memory operation even when the printheads are configured for interchangeable ink tanks.

The current printhead and memory operation configuration may increase the page-per-minute printing speed for configurations actually requiring fewer read and/or write steps than that for the standard configuration (e.g., four). For example, if it takes about 500 milliseconds to perform a read and/or write step per memory tag, a printhead having only two memory tags would still take as long as about 2 seconds, even though only two read and/or write steps need to be performed because the carriage and the memory tag reader perform the same steps to read from each of the four default locations, notwithstanding the configuration of the printhead in use.

The current configuration for reading ink tank memory tags in each of the default location, regardless of the ink tank configuration negatively impacts the potential printing speed due to extraneous read and/or write steps being performed. There remains an unsatisfied need in the industry for utilizing ink tank memory tags to indicate the configuration of the ink tanks, so as to inform the printer firmware and to perform more efficient memory operations, thus improving print speeds.

Accordingly, there exists a need for methods and systems using printhead tank memory to determine printhead tank configuration.

BRIEF SUMMARY OF TIDE INVENTION

Embodiments of the invention can address some or all of the needs described above. Embodiments of the invention are directed generally to methods and systems using printhead tank memory to determine printhead tank configuration.

One example embodiment of the invention may include a printhead ink tank. The printhead ink tank may include a memory tag readable by a printer memory tag reader in communication with a printer controller. The memory tag may further include ink tank configuration instructions that include at least one of an ink tank configuration identifier or at least one ink tank location identifier. The ink tank configuration instructions can cause the printer controller to perform at least one memory operation associated with the memory tag.

According another example embodiment of the invention, a system for determining printhead ink tank configurations may be provided. The system may include a printer that includes a memory tag reader and a printer controller. The system may further include a printhead with at least one ink tank. Each ink tank in the system may be associated with a memory tag. At least one of the memory tags associated with the ink tank or tanks includes ink tank configuration instructions having at least one of an ink tank configuration identifier or at least one ink tank location identifier. The printer controller and the memory tag reader may be operable to perform at least one memory operation associated with the memory tag or tags, responsive to the ink tank configuration instructions.

Yet a further example embodiment of the invention may include a method of determining a printhead ink tank configuration. The method may entail generating a memory operation instruction by a printer controller. The method may further entail performing a first memory operation associated with a first memory tag associated with a first ink tank, wherein the first memory operation includes reading from the first memory tag a first ink tank configuration instruction. The method may further include continuing the memory operation instruction responsive to the first ink tank configuration instruction.

Other systems, processes, printing devices, and apparatuses according to various embodiments of the invention will become apparent with respect to the remainder of this document.

BRIEF DESCRIPTION OF THE SEVERAL VIEWS OF THE DRAWINGS

Having thus described the invention in general terms, reference will now be made to the accompanying drawings, which are not necessarily drawn to scale.

Figure 1:
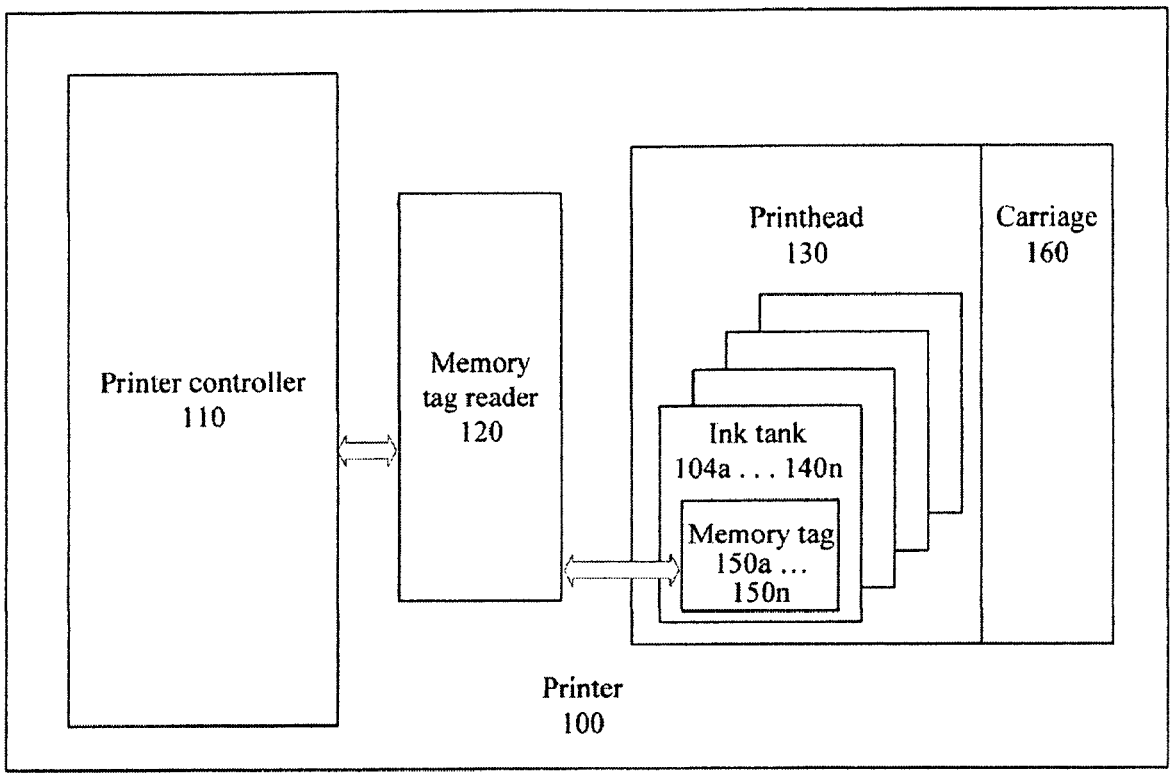

FIG. 1 is an example functional block diagram of a printer, according to an illustrative embodiment of the invention.

Figure 2A:
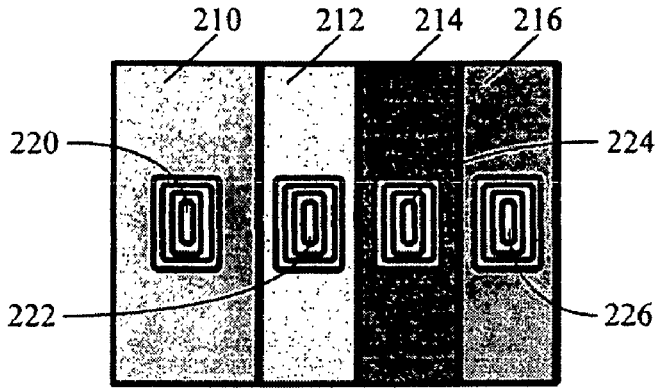

FIG. 2A an example functional block diagram of a printhead ink tank configuration, according to an illustrative embodiment of the invention.

Figure 2B:
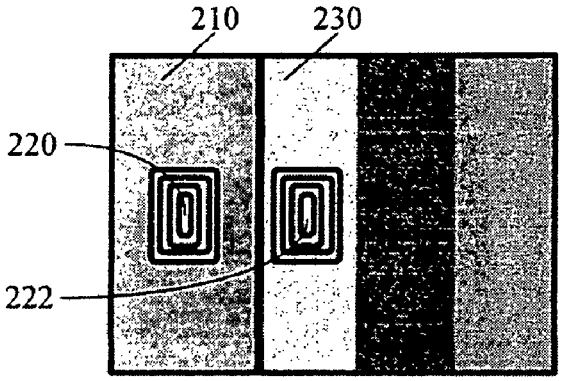

FIG. 2B an example functional block diagram of a printhead ink tank configuration, according to an illustrative embodiment of the invention.

Figure 2C:
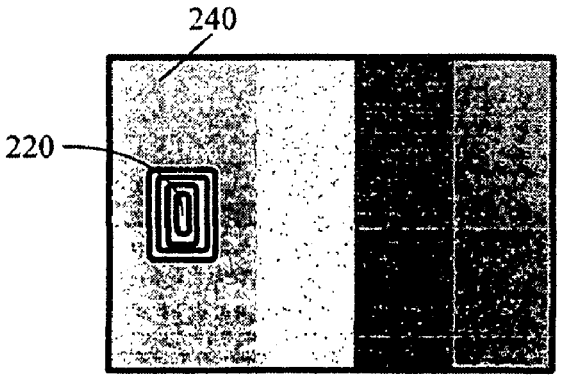

FIG. 2C an example functional block diagram of a printhead ink tank configuration, according to an illustrative embodiment of the invention.

Figure 3A:
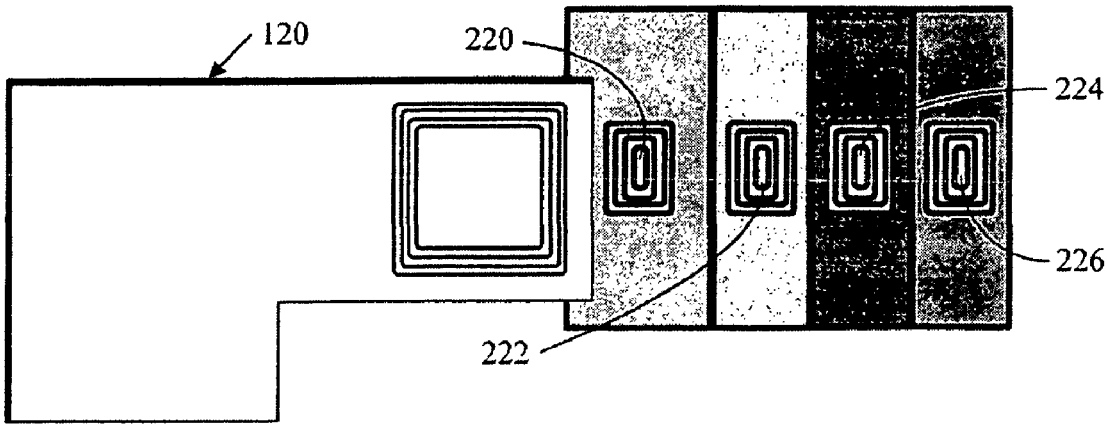

FIG. 3A an example functional block diagram of a printhead ink tank configuration with a memory tag reader, according to an illustrative embodiment of the invention.

Figure 3B:
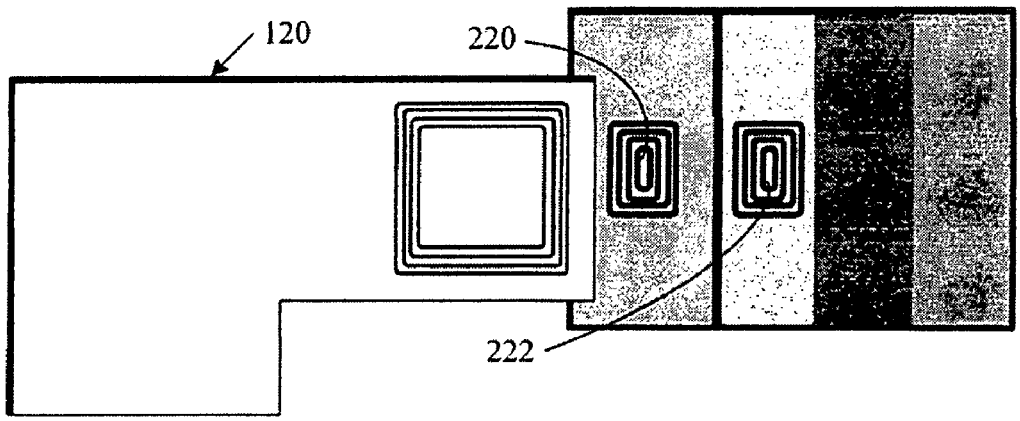

FIG. 3B an example functional block diagram of a printhead ink tank configuration with a memory tag reader, according to an illustrative embodiment of the invention.

Figure 3C:
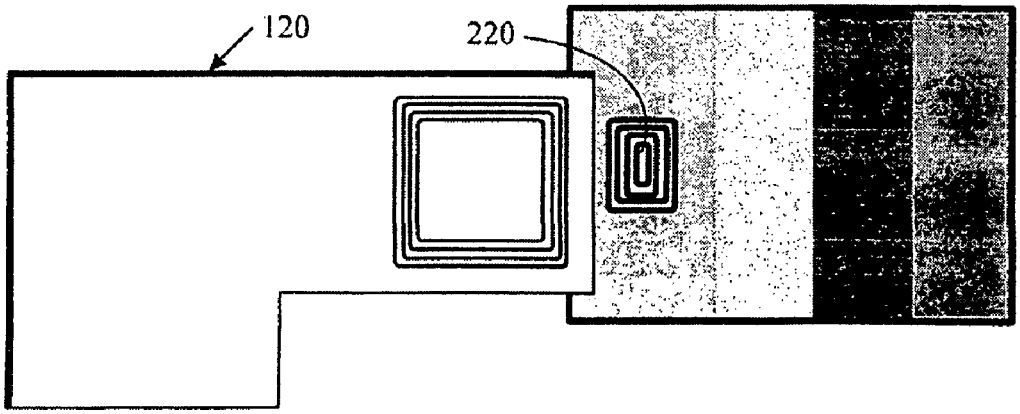

FIG. 3C an example functional block diagram of a printhead ink tank configuration with a memory tag reader, according to an illustrative embodiment of the invention.

Figure 4:
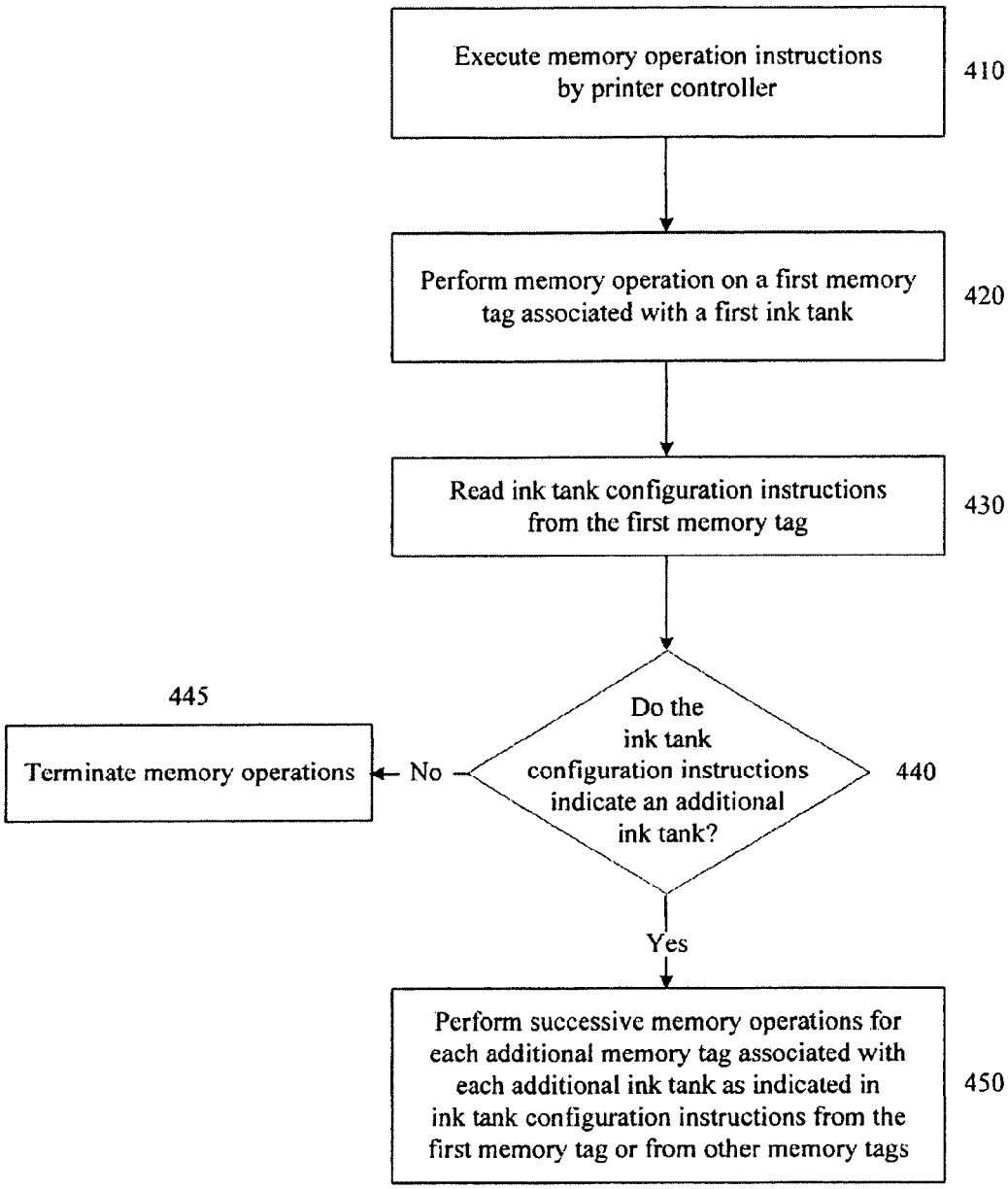

FIG. 4 is an example flow diagram of a method of performing memory operations on ink tank memory tags, according to an illustrative embodiment of the invention.

Figure 5:
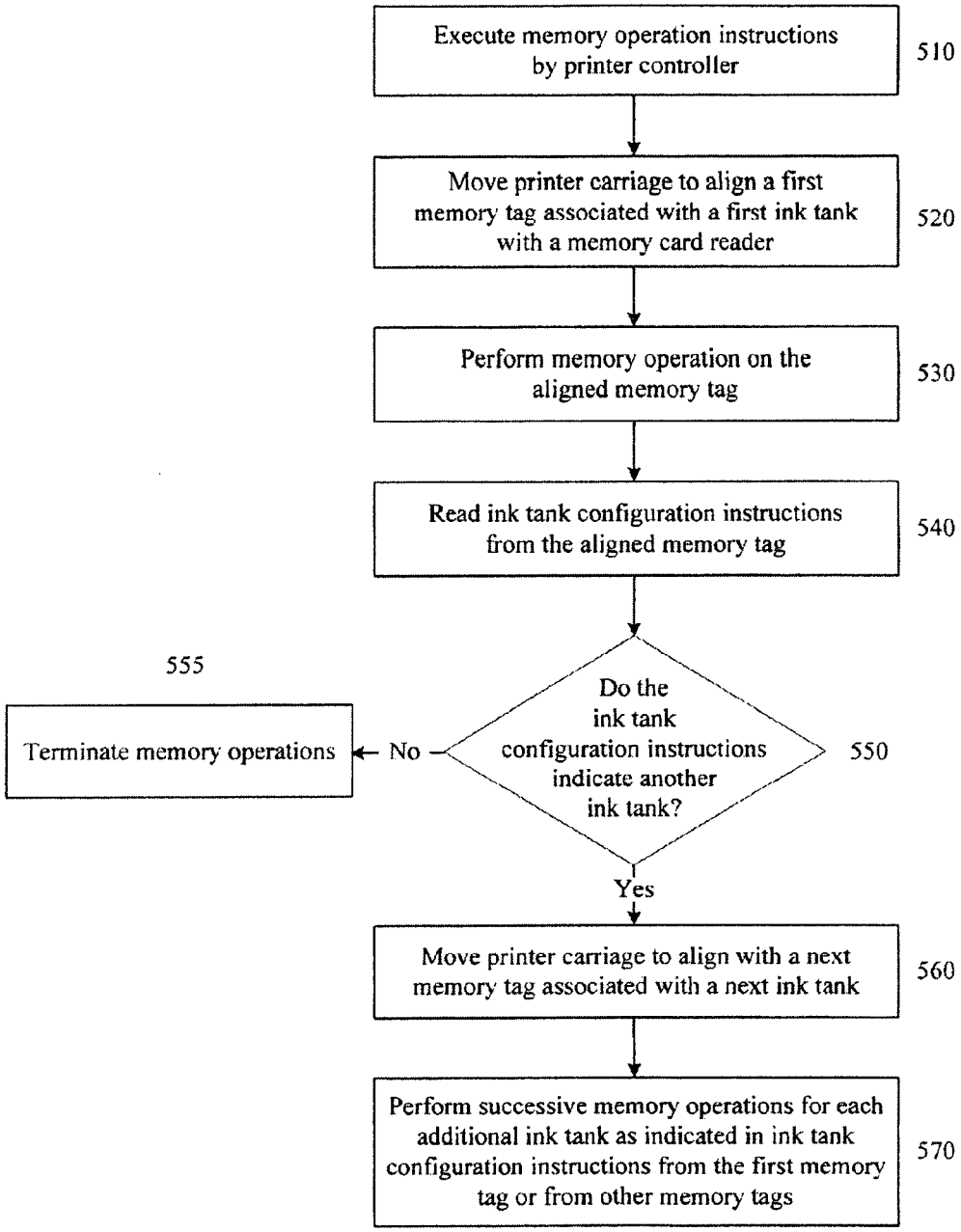

FIG. 5 is an example flow diagram of a method of performing memory operations on ink tank memory tags requiring alignment with a memory tag reader, according to an illustrative embodiment of the invention.

Figure 6:
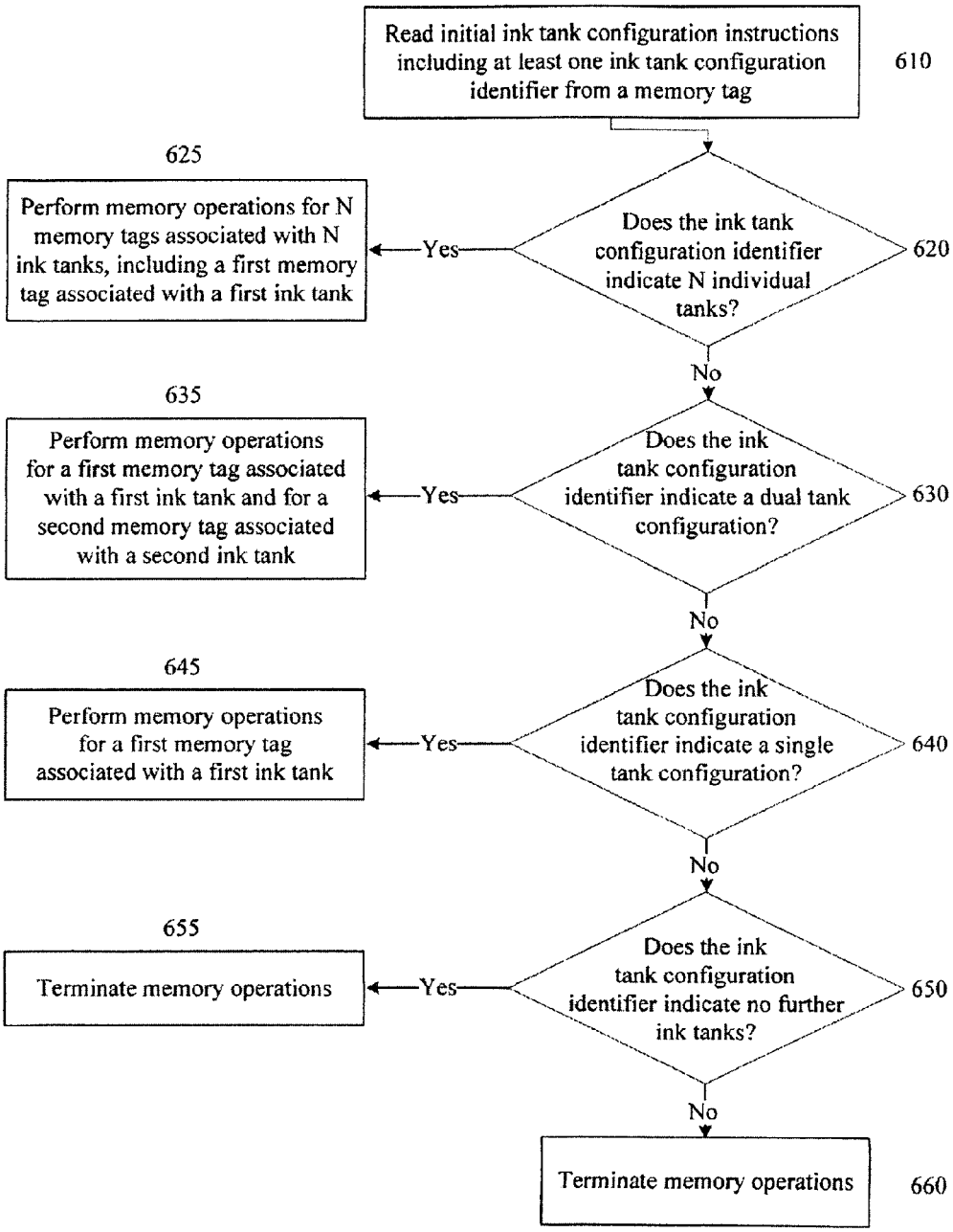

FIG. 6 is an example flow diagram of a method of performing memory operations on ink tank memory tags having stored thereon an ink tank configuration identifier, according to an illustrative embodiment of the invention.

DETAILED DESCRIPTION OF EMBODIMENTS OF THE INVENTION

Embodiments of the invention now will be described more fully hereinafter with reference to the accompanying drawings, in which some, but not all embodiments are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Further, although embodiments of the invention is described in the context of storing and reading memory tags associated with interchangeable ink tanks on printer printheads, it will be appreciated that embodiments of the invention may be implemented in any device having interchangeable components with a memory device associated with each of the individual interchangeable components. In brief, embodiments of the invention may be implemented in any electronic device, or hardware device having electronic components therein, in which interchangeable components include memory devices and allow access for memory operations by the electronic device's firmware or electronic controller or processor. Therefore, these example methods and systems for identifying interchangeable component configuration through a memory identification are for illustrative purposes only and are not intended to be limiting examples.

In imaging and printing devices, memory devices may be included with one or more of the hardware components to store information specifically about that component, for example usage data, status data, and the like. Furthermore, the imaging and printing devices may include hardware components that have interchangeable configurations, allowing the user to tailor the hardware to their intended use. This is in some ways accomplished by creating a standard configuration, such as a standard footprint having standard physical and electrical connection points, wherein different components can be fit within the standard configuration by mounting or attaching to the same physical connection points and electrical connection points.

For example, as described further below, some computer printers, for example ink jet printers, may include on-carriage printheads which are in physical communication with a printer carriage and move with the printer carriage back-and-forth across the print medium (e.g., paper) during printing operations. The printheads can include one or more ink tanks that may be interchangeable and offer multiple configurations. Example configurations may include a single ink tank including, but not limited to, a monochromatic ink well, a yellow ink well, a cyan ink well, and a magenta ink well, or a dual ink tank configuration including a monochromatic ink well in a first tank and yellow, cyan, and magenta ink wells in a second ink tank. Other configurations may include any number of individual ink tanks, such as four individual ink tanks, for example, one with monochromatic ink, one with yellow ink, one with cyan ink, and another with magenta ink.

However, it should be noted that ink tank configurations to which the invention applies should not be limited to those example configurations explicitly discussed. As alternative examples, instead of yellow, cyan, and magenta, the ink tanks may include other colorants, such as red, green, and blue. Additionally, the number of ink tanks which may be associated with one or more printheads in the printer shall not be limited, and could include up to N number ink tanks, wherein N is not limited to those example embodiments discussed herein. It is also appreciated, that the invention is not limited to printhead hardware and is applicable to other electronic devices that may include a memory device on interchangeable components that would alter the number of or configuration of the memory devices, based on the alternate interchangeable configurations.

Embodiments of the invention can include memory devices associated with interchangeable hardware components, and processes related thereto can eliminate or otherwise minimize unnecessary memory operations, depending upon the unique hardware component configuration. According to one example, a memory tag may be associated with one or more of the ink tanks installed in a computer printer printhead, and the memory tag may have ink tank configuration instructions that indicate the current configuration of the ink tanks installed in the printhead. Upon performing a memory operation on the first memory tag associated with the first ink tank, the printer controller reads the ink tank configuration instructions stored on the first memory tag to determine whether other ink tanks are currently installed in the printhead. If other ink tanks are currently installed, the printer controller will execute the necessary steps to perform a memory operation on the next memory tag associated with the next ink tank. If there are no other ink tanks installed, the printer controller will not perform any extraneous memory operations that would have been performed without having an ink tank configuration instruction stored on one or more of the memory tags.

FIG. 1 illustrates a functional block diagram of an example printer system including a printhead with interchangeable ink tanks in accordance with an embodiment of the invention. The printer 100 may include a printer controller 110. The printer controller 110 may be generally referred to as the firmware. The printer controller 110 may be an application-specific integrated circuit (ASIC), or a general processor or microprocessor running on a computing device to execute the printer's operating programs and functions, such as those functions described herein, as well as others. To implement the functions described herein, the printer controller 110 may also include software, hardware, or a combination thereof, and may include one or more integrated components in close proximity or components that are distributed throughout the printer.

The printer 100 may also include at least one printhead 130, into which one or more ink tanks 140*a*, 140*b*, . . . 140*n* may be installed or otherwise mounted to. The printhead 130 may be configured so as to allow multiple ink tank configurations to be installed, as is described further with reference to FIGS. 2A-2C. Each ink tank 140*a*-140*n* can include at least one memory tag 150*a*, 150*b*, . . . 150*n*. Each of the memory tags described herein may be a read only memory (ROM) device that may be programmed as part of the manufacturing process (PROM), or a non-volatile random access memory (NVRAM) device, such as flash memory or ELPROM memory. The use of read only memory allows information to read from the memory by a printer electronic controller, while random access memory allows information to be stored and read from the memories by the controller. The printhead may be in mechanical communication with a carriage 160 that is electronically controlled by the printer controller 110 and moves the printhead 130 across the paper for performing printer functions and, optionally, aligning the memory tags 150*a*-150*n* with a memory tag reader.

The printer 100 also may include a memory tag reader 120. The memory tag reader 120 may be a separate hardware component which facilitates the read and/or write memory operations performed on each memory tag 150*a*-150*n*, as is described more fully below with reference to FIGS. 3A-3C. Alternatively, however, in some example embodiments that do not require an additional hardware component to perform memory operations on the memory tags 150*a*-150*n*, the memory tag reader 120 may be an operating instruction module programmed in the memory of the printer controller 110. For example, in embodiments where the memory tags 150*a*-150*n* are in constant electrical connection with the printer controller 110, the memory tag reader 120 is considered to be the part of the operating instructions programmed in the printer controller 110 that facilitate the execution of memory operations. Thus, while FIG. 1 illustrates the memory tag reader 120 as a separate block in the functional block diagram, in certain embodiments it may be a component of the printer controller 110. Furthermore, it is appreciated that in example embodiments wherein the memory tag reader 120 is an additional hardware component that facilitates the communication between the printer controller 110 and the memory tags 150*a*-150*n*, the printer controller 110 may additionally be programmed to include operating instructions to execute the memory operations on the memory tags 150*a*-150*n* by way of the memory tag reader 120.

Accordingly, while FIG. 1 illustrates individual functional components of a single functional block diagram, it is appreciated that some of the functional components may be combined or functions shared in other components. Thus, the functional block diagram of the printer 100 illustrated in FIG. 1 shows an example printer 100, and other configurations are possible.

FIG. 2A illustrates an example ink tank configuration having four (4) ink tanks 210, 212, 214, 216, which may be installed in the computer printer printhead in accordance with an embodiment of the invention. More specifically, in one example, a first ink tank 210 may be a monochromatic ink tank (e.g., containing a first color, such as black ink), a second ink tank 212 may include ink having a second color (e.g., a yellow ink tank), a third ink tank 214 may include ink having a third color (e.g., a cyan ink tank), and a fourth ink tank 216 may include ink having a fourth color (e.g., a magenta ink tank). It is appreciated that the colors described herein are provided as example ink colors, and that the ink tanks may be used for other colors. Alternatively, any of the individual ink tanks included in the configuration may have the same ink color as one or more other ink tanks in the configuration. Each ink tank illustrated in FIG. 2A can include at least one memory tag 220, 222, 224, 226.

An alternative ink tank configuration, as illustrated in FIG. 2B, may be a dual-tank configuration which includes a first ink tank 210 and a second ink tank 230. In one example of the dual-tank configuration, the first tank 210 may be a monochromatic ink tank (e.g., containing a first color, such as black ink), such as that described with reference to FIG. 2A above, and the second ink tank 230 may be configured with more than one ink well. For example, the second ink tank 230 may be a tri-color ink tank that includes three ink wells for a second, a third, and a fourth ink color (e.g., yellow, cyan, and magenta).

In the dual-tank configuration example shown in FIG. 2B, the first ink tank 210 may include a first memory tag 220 and the second ink tank 230 may include a second memory tag 222. For reasons as will be more fully discussed below, in certain example embodiments the location of the second memory tag 222 is similar to the location for the second memory tag for the individual ink tank configuration, as is illustrated in FIG. 2A. For example, to simplify programming of the printer controller and to simplify operation of the carriage in embodiments in which the carriage aligns the one or more memory tags with the memory reader, the location of memory tags on respective tanks between the different configurations can be similar. Comparing the example illustrated in FIG. 2B to the example illustrated in FIG. 2A shows the first memory tag 220 and the second memory tag 222 at substantially similar locations in each configuration.

FIG. 2C illustrates a third example embodiment of ink tank configurations having a single ink tank 240. The single ink tank 240 may have only one ink well for a single ink color, or may include multiple ink wells for containing multiple colors. For example, a single ink tank 240 may include four wells, as is specifically illustrated by example in FIG. 2C, for a monochromatic ink, yellow ink, cyan ink, and magenta ink. It is appreciated, however, that the number of ink wells included in a single ink tank configuration is not limited by these descriptions, and that the single ink tank 240 may include as many ink wells for as many ink colors as is desirable for the printer configuration and intended use.

The example embodiment of a single ink tank 240, as illustrated in FIG. 2C, includes one memory tag 220. As discussed above, it may be desirable that the memory tag 220 is affixed to the ink tank 240 at substantially the same location as it would be attached to the first ink tank 210, illustrated in FIGS. 2A-2B.

While FIGS. 2A-2C illustrate the memory tags being affixed to the top surface of each ink tank, it is appreciated that memory tags may be affixed to other surfaces of the ink tanks, depending upon the specific printhead configuration, the memory reader configuration, or the available electrical connections. For example, in embodiments where the memory tag is a standard read or readable/writeable memory device in constant electrical communication with the printer controller, the memory tags may be located, for example, on a bottom surface or on a edge surface, so as to allow electrical contact with electrical connections in the printhead device or ink tank holding device of the printer.

In other example embodiments, it is appreciated that the ink tank configuration may include any combination of on-carriage ink tanks, such as that described in any of the FIGS. 2A-2C, and/or any combinations of off carriage ink tanks.

FIGS. 3A-3C illustrate example embodiments of the ink tank configurations discussed with reference to FIGS. 2A-2C that include a memory tag reader 120. In these example embodiments, the memory tags may be radio frequency identification (RFID) tags. RFID technology allows for radio communication between the memory tags and the memory tag reader 120. More specifically, RFID systems include at least an antenna or coil, a transponder (for example, the memory tag here), and a transceiver (for example, collectively the memory tag reader here). The transceiver is the device that may perform the read and/or write operations at the transponder by generating radio signals which are emitted through the transceiver's antenna or coil. If the transponder is passive, the radio signals generated by the transceiver excite the passive transponder, causing the transponder to emit a signal in response to the transceiver's radio signal. Alternatively, an active transponder may have an internal power source, such as a battery, and typically be capable of performing read and write memory operations. The signal emitted by the transponder may carry whatever information may be stored in an information storage medium associated with the RFID device, for example a memory device as described above (e.g., ROM, PROM, EEPROM, NVRAM).

An embodiment utilizing RFID technologies may include a memory tag reader 120, which may act as a transceiver and antenna or coil, and at least one memory tag 220, 222, 224, 226, which may act as a transponder and memory device in combination (also referred to herein as an RFID tag or an RFID memory tag). The information stored in the memory device may include information regarding the status and usage of the printer, printhead, ink tanks, including the ink tank configuration instructions, as described more fully below. The memory tag reader 120 operating as a transceiver may be in electrical communication with the printer controller.

In one example embodiment, the memory tag reader 120 may be attached to the printer at a fixed location, and the printer carriage, to which the printhead and ink tank or tanks are attached, may move the printhead and ink tank or tanks to align or bring within close proximity the memory tags 220, 222, 224, 226 and the memory tag reader 120 for performing memory operations. Aligning the memory tags 220, 222, 224, 226 allows the memory tag reader 120 to read the specific memory tag aligned with the memory tag reader. The printer controller may cause the carriage to move for each ink tank that is identified as being installed in the printhead. In another example embodiment, the memory tag reader 120 may be installed on a moveable member, wherein one or both of the carriage and the memory tag reader 120 may move to align the memory tags with the memory tag reader 120.

In other example embodiments, the memory tag may not be integrated with an RFID tag, and may be in electrical communication with the printer controller. In these example embodiments, the memory tag reader may represent operating instructions programmed in the printer controller firmware, and may not align with the memory tags during memory operations. Because the memory tags (e.g., ROM, PROM, NVRAM, EEPROM memory devices) are in electrical connection with the printer controller, the printer controller can perform the memory operations without aligning. In these embodiments having the memory tag in constant electrical connection, the memory tags may be affixed at any point on the ink tanks, so long as an electrical contact with the printer controller is made.

However, in another example embodiment, the memory tags may not be in constant electrical connection with the printer controller, and a memory tag reader, much like that described above with regards to embodiments including RFID tags, may make a temporary electrical contact with the memory tags upon alignment. For example, the memory tag reader may have electrical contact points which engage and create a temporary electrical connection when the carriage moves the printheads and align each memory tag associated with each ink tank with the memory tag reader. It is appreciated that any combination of memory tags and electrical or wireless connectivity may be implemented and still be within the scope of embodiments of the invention.

FIG. 4 illustrates an example method 400 by which the printer controller performs memory operations with at least one ink tank containing a memory tag having ink tank configuration instructions stored thereon in accordance with an embodiment of the invention. At block 410, the printer controller executes memory operation instructions. The memory operation instructions are initiated to cause the printer controller to perform at least one read and/or write memory operation on at least one memory tag associated with at least one of the printhead ink tanks.

Block 420 follows block 410, in which the printer controller performs the first memory operation on the first memory tag associated with the first (or in some embodiments, the only) ink tank: installed in the printhead. Before execution of these methods and procedures, at least one ink tank may be installed in the printer's printhead in any of the configurations as described in FIGS. 2A-2C, or various other configurations. As is described in reference to FIGS. 2A-2C, in any ink tank configuration (e.g., single, dual, or N ink tank configurations) at least one memory tag will be associated with at least one ink tank. The memory operations performed on the first memory tag (and each other memory tag for which the printer controller executes memory operations) may be a read and/or a write memory operation. The printer controller may be receiving information on the usage of the ink tank, such as how much ink has been used in each tank, how much ink remains, the type of the ink in each tank to verify compatibility of the ink with the current printer configuration, and the like. Furthermore, it is appreciated that other operations may be performed before, during, and/or after the memory operations as described by method 400. For example, the printer controller may include authorization steps before performing any other memory operations with each new memory tag for which additional memory operations are to be performed.

Following block 420 is block 430, in which the printer controller additionally reads ink tank configuration instructions from the first memory tag. The ink tank configuration instructions may include an identifier that indicates the current printhead ink tank configurations. For example, the ink tank configuration instructions may indicate any of the ink tank combinations as described above in reference to FIGS. 2A-2C. In one example embodiment, an ink tank configuration identifier may indicate how many ink tanks are installed in the printhead. This information may be programmed in the memory tag during manufacturing of the ink tanks, or at some time prior to use. The ink tank configuration identifier may indicate the exact configuration of all ink tanks currently installed in the printhead because some ink tanks can only be installed with other ink tanks in a single, exact configuration. For example, the first ink tank may be the only ink tank in a single ink tank configuration (such as for example that illustrated in FIG. 2C), and the ink tank configuration identifier may indicate this configuration.

However, in other example embodiment, the first ink tank may be used in more than one configuration type, and the ink tank configuration identifier may indicate that there exists at least one more ink tank. For example a first ink tank may be a monochromatic ink tank and the remainder ink tanks may be three individual colored ink tanks (such, as for example, that illustrated in FIG. 2A). Alternatively, the same monochromatic first ink tank may be installed in a dual ink tank configuration having only a second, tri-color ink tank (such as, for example, that illustrated in FIG. 2B). Accordingly, for each of these two configurations—the N ink tank configuration and the dual ink tank configuration—the ink tank configuration identifier may be programmed so as to indicate that at least one other ink tank exists. Programming the ink tank configuration identifier in this manner provides flexibility, allowing the first ink tank to be used interchangeably in any configuration including more than one ink tank and having the same ink tank configuration instructions stored on its memory tag.

The ink tank configuration identifier may be represented in various ways without departing from the scope of the invention. Example configuration identifiers may be, but not limited to: a single digit identifying the specific location of the ink tank with a digit reserved for indicating that no other ink tanks exist (e.g., in an N ink tank configuration: 1 on the first memory tag represents the first ink tank, 2 on the second memory tag represents the second ink tank, 3 on the third memory tag represents the third ink tank, and 0 on the fourth memory tag represents that no other ink tanks are installed); a single digit identifying the next ink tank with a digit reserved from indicating that no other ink tanks exist (e.g., in a dual ink tank configuration: 2 on the first memory tag represents that the second ink tank is the next ink tank and 0 on the second memory tag represents that no other ink tanks are installed); a multi-digit with one digit identifying the exact ink tank being read and another digit identifying the total number of ink tanks (e.g., in an N ink tank configuration: 14 on the first memory tag represents the first ink tank of four ink tanks, 24 on the second memory tag represents the second ink tank of four ink tanks, 34 on the third memory tag represents the third ink tank of four ink tanks, and 44 represents the fourth and final ink tank); a single digit (e.g., binary values) identifying that another ink tank exists or not (e.g., in a dual ink tank configuration: 1 on the first memory tag indicates that another ink tank exists, 0 on the second memory tag indicates that no other ink tanks exist); or a value indicating the total number of ink tank installed (e.g., in a N=four ink tank configuration: 4 on the first memory tag represents that there are a total of four ink tanks installed). The printer controller may be programmed to know, based on the configuration identifier, how many memory operations to perform, and/or where to perform them.

Ink tank configuration instructions programmed with an ink tank configuration identifier may be used in any of the above memory device configurations. For example, the ink tank configuration identifier can indicate to the printer controller how many and for which ink tanks memory operations need to be performed in an embodiment having memory tags in constant electrical connection (and not requiring alignment of the memory tags). Additionally, however, in embodiments such as those including RFID capable memory tags that align the memory tags with a memory reader, the printer controller can be programmed to identify the location of the each memory tag, depending upon the ink tank configuration as identified by the instructions. This may be performed by a relatively simple lookup function by the printer controller program.

Differently, instead of including an ink tank configuration identifier, the ink tank configuration instructions may be programmed to include an ink tank location identifier. The ink tank location identifier may indicate, by various means, the location of the next ink tank if there is another ink tank. The ink tank location identifier may indicate a distance from a specific point on the path along which the carriage travels that indicates the location of the next memory tag. For example, ink tank configuration instructions on the first memory tag associated with the first ink tank may include an ink tank location identifier that indicates that the next memory tag (for example, the memory tag on the tri-color ink tank in a dual ink tank configuration) is about 25 centimeters from the beginning point of carriage travel, similar to identifying a point on an x-axis where the carriage travels along the x-axis beginning at the zero point of the x-axis.

Alternatively, the ink tank location identifier may indicate a distance from the current location that indicates the location of the next memory tag. For example, the ink tank location identifier programmed on the first memory tag may indicate that the next memory tag is about 8 millimeters from the location of the first memory tag, allowing the printer controller to cause the carriage to travel about 8 millimeters to the next memory tag. Ink tank configuration instructions programmed with an ink tank location identifier are beneficial for those embodiments, such as those including RFID capable memory tags, that align the memory tags with a memory reader. However, it is appreciated that the printer controller may be programmed to use the location identifier, much like the configuration identifier described above, to indicate how many and for which tanks memory operations are to be performed in embodiments having constant electrical connectivity and not requiring physical alignment.

The ink tank location identifier may be represented in various ways without departing from the scope of the invention. Example configuration identifiers may be, but not limited to: a single value indicating an offset from a constant location on the axis over which the carriage travels indicating the location of the next ink tank with a value reserved to identify that no other ink tanks exist (e.g., in an N ink tank configuration: 26 on the first memory tag indicates that the second memory tag is 26 from the constant location, 26.5 on the second memory tag indicates that the third memory tag is 26.5 from the constant location, 27 on the third memory tag indicates that the fourth memory tag is 27 from the constant location, and 0 on the fourth memory tag indicates that there are no other ink tanks installed); a single value indicating a distance from the current memory tag's location with a value reserved to identify that no other ink tanks exist (e.g., in a dual ink tank configuration: 8 on the first memory tag indicates that the second memory tag is about 8 centimeters from the first memory tag, 0 on the second memory tag indicates that no other memory tags exist).

Block 440 follows block 430, in which the printer controller reads the ink tank configuration instructions from the first memory tag to determine whether other ink tanks are installed and thus whether additional memory operations are to be performed. The ink tank configuration instructions may indicate by either a configuration identifier or a location identifier, as described above, whether there are other ink tanks present and in some embodiments the exact configurations of all of the ink tanks. If at block 440 the ink tank configuration instructions indicate there are other ink tanks present, the printer controller at block 450 may continue to perform additional memory operations for each ink tank present. If at block 440 the ink tank configuration instructions indicate there are no other ink tanks present (such as for example in a single ink tank configuration), following the "no" path from block 440, all of the necessary memory operations have been performed and the printer controller terminates the memory operation instructions, at block 445. Accordingly, by including ink tank configuration instructions in the memory tag, the printer controller will only perform memory operations for ink tanks present, and thus eliminate any unnecessary attempts to perform memory operations as would be performed if the memory tags did not include ink tank configuration instructions. Therefore, these ink tank configuration instructions allow for more efficient processing by the printer controller, and will help to increase the print speed for ink tank configurations having less than a default number of ink tanks.

FIG. 5 illustrates an example method 500 by which the printer controller may perform memory operations on memory tags having ink tank configuration instructions, for memory tags that align with a memory tag reader to perform the memory operations in accordance with an embodiment of the invention. For example, memory tags having RFID capabilities, as described in more detail above in reference to FIGS. 3A-3C, may cause the memory tags to be aligned with the memory tag reader. In another example, memory tags for which a temporary electrical connection is created by contact points on a memory reader, also described in reference to FIGS. 3A-3C, may align the memory tags with the memory reader.

At block 510, the printer controller executes memory operation instructions. The memory operation instructions are initiated to cause the printer controller to perform at least one read and/or write memory operation on at least one memory tag associated with at least one of the printhead ink tanks.

Following block 510 is block 520, in which the printer controller directs the carriage to move so as to align a first memory tag associated with a first ink tank installed in the printhead with the memory tag reader. As discussed above, the first ink tank may be a monochromatic ink tank installed with N other ink tanks (e.g., a yellow ink tank, a cyan ink tank, and a magenta ink tank), the first ink tank may be a monochromatic ink tank installed in a dual configuration with one other ink tank (e.g., a tri-color ink tank), or the first ink tank may be installed as a single ink tank (e.g., having ink wells for multiple ink colors such as black, yellow, cyan, and magenta).

After the first memory tag associated with the first ink tank is aligned with the memory tag reader at block 520, the memory tag reader performs at least one read and/or write memory operation with the memory tag at block 530. If the memory tag is an RFID memory tag, the memory tag reader transmits a radio signal to the first memory tag with which it is aligned, which causes the RFID memory tag to respond with by emitting a signal containing information on the memory tag. Additionally, if the RFID memory tag is an active device and associated with read/writeable memory, the memory tag reader may cause information to be written to the memory tag.

At block 540 following block 530, when performing the memory operations on the first memory tag, the printer controller causes the memory tag reader to read at least one ink tank configuration instruction from the first memory tag. The ink tank configuration instructions may include at least one of an ink tank configuration identifier or an ink tank location identifier, both of which are described in detail with respect to FIG. 4. Following block 540 is block 550, in which the memory tag reader determines whether the ink tank configuration instructions indicate additional ink tanks that include memory tags for which a memory operation may be performed.

If the ink tank configuration instructions, by way of either an ink tank configuration identifier or an ink tank location identifier, indicate that there is at least one more ink tank installed in the printhead, the printer controller causes the carriage to move the printhead to align the next memory tag on the next ink tank with the memory tag reader at block 560, which follows the "yes" path from block 550. Then, at block 570 following block 560, the memory tag reader and the printer controller perform another read and/or write memory operation with the next memory tag. Upon performing this next memory operation, the memory tag reader again reads ink tank configuration instructions from this next ink tank, to determine if yet further ink tanks are installed in the printhead. If further ink tanks are indicated by the ink tank configuration instructions, the printer controller causes the carriage to align the next memory tag with the memory tag reader and perform another memory operation. This is repeated for as many ink tanks as are indicated by the ink tank configuration instructions read from at least one of the memory tags as being installed in the current printhead. It is appreciated that in another example embodiment, the first memory tag may include ink tank configuration instructions that identify the entire ink tank configuration and thus no other ink tank configuration instructions need to be stored or read from successive ink tanks installed. Alternatively, in a similar example embodiment, the first ink tank memory may include ink tank configuration instructions that indicate whether or not a second tank is installed, but do not indicate the entire ink tank configuration. In this alternative embodiment, the second ink tank memory tag may include ink tank configuration instructions that indicate the entire ink tank configuration, or may again indicate whether a third or more ink tanks are installed.

Block 555 follows the "no" path from block 550, in which the ink tank configuration instructions indicate that no other ink tanks are installed in the printhead, and the printer controller may terminate the memory operation instructions, causing the carriage to refrain from aligning a further ink tank memory tag and halting further read and/or write memory operations. Again, by indicating the configuration of the ink tanks currently installed in the printhead, unnecessary memory operation attempts are avoided and print speed may be increased.

FIG. 6 illustrates in more detail an example method 600 by which the printer controller reads ink tank configuration instructions that include an ink tank configuration identifier. The method illustrated by FIG. 6 describes three example ink tank configurations as exemplary configurations only, and should not be taken as a limiting illustration. Accordingly, as described more fully above, it is appreciated that the subject matter described herein is applicable for any ink tank configuration as may be installed in the printhead.

At block 610, the printer controller and the memory tag reader read ink tank configuration instructions from the first memory tag associated with the first (or initial) ink tank installed in the printhead. These configuration instructions include an ink tank configuration identifier which may indicate the configuration of the ink tanks installed in the printhead. As described in detail above with reference to FIG. 4, the ink tank configuration identifier may be programmed in many forms. Furthermore, the ink tank configuration identifier may either indicate the entire ink tank configuration as currently installed in the printhead, or alternatively (and not described in detail by FIG. 6) it may indicate whether there is a next (or second) ink tank installed in the printhead.

Block 620 follows block 610, in which the printer controller and the memory tag reader may determine whether the ink tank configuration identifier indicates an N configuration ink tank, wherein N indicates how many ink tanks in total are installed. For example, in a typical individual ink tank configuration, the N would indicate that there are four (4) total ink tanks installed in the printhead (monochromatic, yellow, cyan, and magenta). If it is determined at block 620 that N ink tanks are currently installed, the printer controller will cause memory operations to be performed for each of the N ink tanks installed at block 625, which follows the "no" path from block 620. The memory operations performed are described in detail with reference to FIG. 4. For example, in an example embodiment wherein the memory tags are in constant electrical connection with the printer controller, the printer controller performs read and/or write operations for each of the installed ink tanks. In another example embodiment, where the memory tags are aligned with a memory tag reader, as described in more detail with reference to FIG. 5, the printer controller causes the carriage to align each memory tag with the memory tag reader and perform the read and/or write memory operations, repeating these operations for each of the N ink tanks.

If the ink tank configuration identifier does not indicate an N ink tank configuration, at block 630, which follows the "no" path from block 620, the printer controller determines whether the ink tank configuration identifier indicates a dual tank configuration. If it is determined that a dual ink tank configuration is currently installed in the printhead, the printer controller causes memory operations to be performed only for the first memory tag associated with the first ink tank, and for the second memory tag associated with the second ink tank at step 635, which follows the "no" path from block 630. The memory operations are performed in the same manner as described at block 625.

Following the "no" path from block 630, if the ink tank configuration identifier does not indicate an N ink tank configuration, and does not indicate a dual ink tank configuration, at block 640, the printer controller determines whether the ink tank configuration identifier indicates a single ink tank configuration. If it is determined that a single ink tank configuration is currently installed in the printhead, the printer controller causes memory operations to be performed only for the first memory tag associated with the first and only ink tank installed in the printhead at block 645, which follows the "yes" path from block 640. Again, the memory operations are performed in the same manner as described at block 625.

Finally, the ink tank configuration identifier may include an indicator that no further ink tanks are installed in the printhead and therefore no further memory operations are to be performed, as is indicated at block 650, which follows the "no" path from block 640. Thus, at block 655, which follows the "yes" path from block 650, the printer controller may terminate the memory operation instructions, so no unnecessary memory operations are attempted. This indicator may be present on the first ink tank when there is a single ink tank configuration, and thus may be used in addition to or in the alternative to a single ink tank configuration identifier as is described with reference to blocks 640 and 645. In some embodiments, an indicator may be included on the last ink tank installed, so as to provide further information or an alternate means to identify that no further ink tanks are installed an no further memory operations are to be performed. For example, in one of the example embodiments described above with reference to FIG. 4, where the ink tank configuration instructions indicate whether there is a next ink tank, and do not indicate the entire ink tank configuration installed, the configuration identifier that indicates no further ink tanks are installed would be stored on the last memory tag associated with the last ink tank installed in the printer. For example, in a dual ink tank configuration, the second memory tag may include this identifier, or in an N ink tank configuration, the Nth memory tag may include this identifier.

Accordingly, the subject matter described herein provides methods and apparatuses that allow for efficiently performing memory operations on memory tags associated with ink tanks installed in printer printheads. Because many of the printers are now configured with printheads that allow for interchangeable ink tanks having varied configurations, there exist benefits to only performing memory operations for ink tanks actually installed in the printhead. This can be achieved by including in memory tags ink tank configuration instructions that either indicate the current configuration of the ink tanks installed or the location of the next memory tag associated with the next ink tank installed, if any. Otherwise, without an indicator of the current ink tank configuration as installed in the printhead, the printer controller may be unaware of how many memory operations to perform, and thus may attempt to perform a memory operation for each possible ink tank location. The competitive printing market urges increasing print speeds to improve printing efficiency. Accordingly, when ink tank memory operations are executed once per page printed, for example, avoiding attempting unnecessary memory operations may reduce the overall time required to perform all of the memory operations, and thus may reduce the negative impact performing memory operations has on printing speeds.

Many modifications and other embodiments of the invention will be apparent by the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The claimed invention is:

1. An ink tank, comprising:

a reservoir for holding ink; and a memory tag associated with the reservoir;

wherein data stored in the memory tag includes ink tank configuration instructions, the ink tank configuration instructions identifying a total number of ink tanks that are installed in a printing system when the ink tank is included as one of the installed tanks.

2. The ink tank of claim 1, wherein the ink tank configuration instructions identifies the ink tank as either: (a) the sole ink tank in a single ink tank configuration, (b) one of two ink tanks in a dual ink tank configuration, or (c) one of N ink tanks in a N-ink tank configuration, where N represents a number greater than two.

3. The ink tank of claim 1, wherein:

the memory tag is configured to be readable by a controller associated with a printer; and when the ink tank configuration instructions identify the ink tank as the sole ink tank in a single ink tank configuration, the controller responds by terminating memory operations.

4. The ink tank of claim 1, wherein the ink tank is a first ink tank and the memory tag is a first memory tag, and wherein further:

the first memory tag is configured to be readable by a controller associated with a printer; and when the ink tank configuration instructions stored in the first memory tag of the first ink tank identify the first ink tank as one of two ink tanks in a dual ink tank system, the controller responds by performing a first memory operation associated with the first tank and a second memory operation associated with the second tank.

5. The ink tank of claim 4, wherein the ink tank configuration instructions cause the controller to terminate the memory operations subsequent to performing the first and the second memory operations.

6. The ink tank of claim 1, wherein the ink tank is a first ink tank and the memory tag is a first memory tag, and wherein:

the first memory tag is configured to be readable by a controller associated with a printer; and when the ink tank configuration instructions stored in the first memory tag of the first ink tank identify the first ink tank as one of N ink tanks in a N-ink tank system, the controller responds by performing a first memory operation associated with the first tank and successive memory operations associated with each of the next (N−1) memory tags, where N represents any number greater than two.

7. The ink tank of claim 1, wherein:

the memory tag is configured to be readable by a controller associated with a printer that can be operated in a plurality of modes depending on how many ink tanks are installed; and wherein further the ink tank configuration instructions identify to the controller the number of ink tanks that will be installed in the printer and the associated mode of operation.

8. The ink tank of claim 1, wherein the ink tank configuration instructions identify a location of at least one other ink tank in a printer having a plurality of installed ink tanks.

9. The ink tank of claim 1, wherein the memory tag is a radio frequency identification memory tag that communicates with a memory tag reader via a radio frequency communications protocol.

10. A method of determining an ink tank configuration in a printing system capable of operating with a plurality of ink tank configurations, comprising:

generating a memory operation instruction by a printer controller;

performing a first memory operation associated with a first memory tag associated with a first ink tank, wherein the first memory operation comprises reading from the first memory tag a first ink tank configuration instruction identifying a total number of ink tanks that are installed in a printing system when the ink tank is included as one of the installed tanks; and continuing the memory operation instruction responsive to the first ink tank configuration instruction.

11. The method of claim 10, wherein the first ink tank configuration instruction comprises at least one of (a) an ink tank configuration identifier, or (b) at least one ink tank location identifier.

12. The method of claim 10, wherein the first ink tank configuration instruction comprises an ink tank configuration identifier that indicates a single ink tank configuration, and wherein further the step of continuing the memory operation instruction comprises terminating the memory operation instruction subsequent to performing the first memory operation, responsive to the first ink tank configuration instruction.

13. The method of claim 10, wherein the first ink tank configuration instruction comprises an ink tank configuration identifier that identifies a dual ink tank configuration, and wherein further the step of continuing the memory operation instruction comprises:

performing a second memory operation associated with a second ink tank, responsive to the first ink tank configuration instruction.

14. The method of claim 10, wherein the first ink tank configuration instruction comprises an ink tank configuration identifier that identifies an N ink tank configuration, where N represent a number greater than two, and wherein further the step of continuing the memory operation instruction comprises:

performing a memory operation associated with each of the next (N-1) memory tags, responsive to the first ink tank configuration instruction.

15. The method of claim 10, wherein the first ink tank configuration instruction comprises an ink tank location identifier that indicates the location of a second ink tank, and wherein further the step of continuing the memory operation instruction comprises:

moving a printer carriage to the location identified by the first ink tank configuration instruction; and performing a second memory operation associated with the second ink tank.

* * * * *